US005437596A

United States Patent [19]

Bogdan et al.

[11] Patent Number: 5,437,596

[45] Date of Patent: Aug. 1, 1995

[54] COMPRESSION PLATE ASSEMBLY FOR A FOLDER BUCKLE CHUTE

[75] Inventors: Vjekoslav Bogdan, Bethel; Steven W. Marcello, Southbury, both of Conn.

[73] Assignee: Pitney Bowes Inc., Stamford, Conn.

[21] Appl. No.: 122,087

[22] Filed: Sep. 17, 1993

[51] Int. Cl.[6] ..... B65H 45/14

[52] U.S. Cl. ..... 493/420

[58] Field of Search ..... 493/419, 420, 421

[56] References Cited

U.S. PATENT DOCUMENTS

| | | | |
|---|---|---|---|
| 1,390,213 | 9/1921 | Olson | 493/419 |
| 2,190,416 | 2/1940 | Davidson . | |
| 4,701,233 | 10/1987 | Beck et al. | 156/217 |
| 5,048,809 | 9/1991 | Tebbe et al. | 270/45 |
| 5,176,614 | 1/1993 | Krasuski | 493/421 |
| 5,183,246 | 2/1993 | Edwards et al. | 270/45 |

*Primary Examiner*—Jack W. Lavinder
*Attorney, Agent, or Firm*—Charles R. Malandra, Jr.; Melvin J. Scolnick

[57] ABSTRACT

In a buckle chute folding apparatus having at least one buckle chute and including a first pair of rollers for feeding one or more sheets into the buckle chute, the buckle chute including upper and lower chute plates having a predetermined gap therebetween and a plurality of stops positioned in within the buckle chute such that the sheet buckles and forms a bulge in the sheet that is grasp by a pair of folding rollers which complete the fold, an improvement comprising structure for narrowing the predetermined gap between the upper and lower chute plates whereby buckling of the sheet within the buckle chute is minimized. The narrowing structure comprises a pair of compression plates, each of the compression plates being secured respectively on the outer face of the upper and lower chute plates.

2 Claims, 3 Drawing Sheets

COMPRESSION PLATE ASSEMBLY FOR A FOLDER BUCKLE CHUTE

FIELD OF THE INVENTION

The invention disclosed herein relates generally to apparatus for folding sheets, and more particularly, to buckle chute folding apparatus.

BACKGROUND OF THE INVENTION

Devices for folding sheets are generally known. For example, U.S. Pat. No. 3,516,655 issued to Schmeck, U.S. Pat. No. 3,510,122 issued to Gavaghan, and U.S. Pat. No. 3,416,785 issued to Sherman all show devices for folding sheets, which include feeding rollers for feeding a sheet, a buckle chute for receiving the sheet and causing it to buckle, and folding rollers for grasping the buckled portion of the sheet in the nip thereof and creasing the buckled portion of the sheet to fold it as the sheet is pulled through. A second buckle chute can be disposed after the folding rollers for receiving the folded edge of the sheet, buckling the remaining portion of the sheet, and folding it by further rollers to form a second fold. Generally, there is an adjustable stop in each buckle chute, which is positioned to accommodate a desired location of the corresponding fold on the sheet. For certain folding applications the location of the fold is significant. For example, a typical billing statement is a form sheet which includes a return portion that can be separated from the remaining portion of the statement by a perforated line extending across the sheet. Preferably, one of the folds will be exactly on the perforated line, thus facilitating tearing of the return portion from the remaining portion of the statement. It has been a common problem that buckle chute folders form folds in the billing statement that are adjacent to the perforated lines of such statements. When the fold is off the perforated line, it is difficult to obtain a clean tear of the return portion from the remaining portion of the billing statement.

It is an object of the present invention to improve the reliability of buckle chute folders to fold on the perforated lines of the billing statements.

SUMMARY OF THE INVENTION

It has been discovered that the problem of folding adjacent to rather than on the perforated lines is the result of having a relatively uniform gap between the plates forming the buckle chute. The gap is fixed at a size adequate to accept the maximum number of sheets that can be folded at one time by the buckle chute folder. Such a gap provides for the folding of single sheets as well as a collation of sheets up to the maximum number of sheets that can be folded at one time by the buckle chute folder. However, having such a gap in the buckle chute causes the sheets, to fluctuate inside the chute during the buckling and folding operation depending on the number of sheets being folded. Typically, buckle chutes have a gap suitable for folding 8 to 14 sheets at a time. For such a gap, single sheets may strike the buckle chute stops at varying locations which will change the fold location so that it occurs in an undesired location, i.e., off the perforation.

It has been discovered that adjusting the gap between the plates forming a buckle chute provides additional control to the location of the fold. Heretofore, the gap between the buckle chute plates has been fixed, and the location of the fold has been controlled by adjusting the position of the buckle chute stops. In accordance with the present invention, means for adjusting the gap is provided so that the gap can be made suitable for folding on the perforated line of a billing statement.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
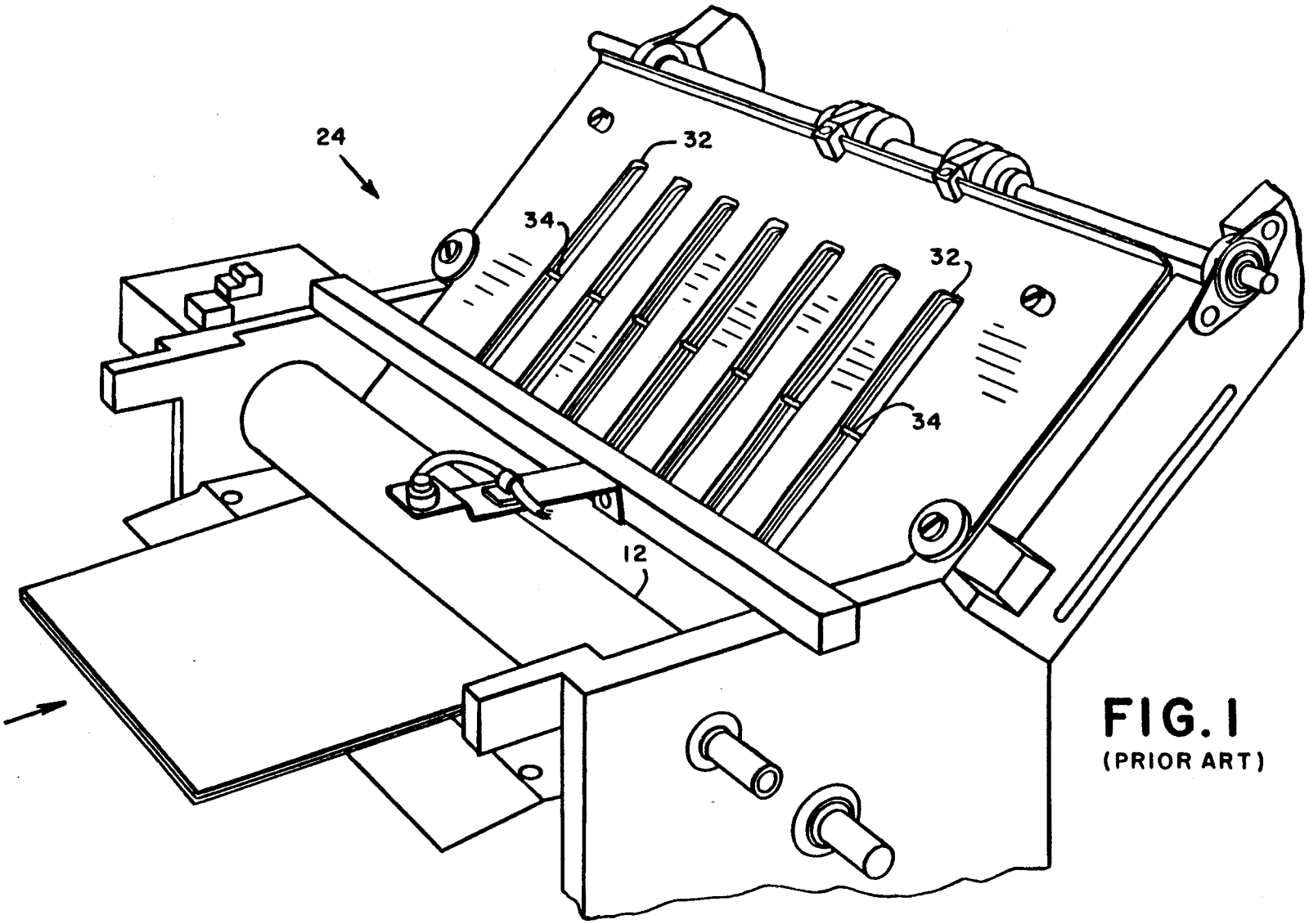
FIG. 1 (PRIOR ART)
FIG. 1 is a perspective view of a prior art buckle chute folder.
Figure 2:
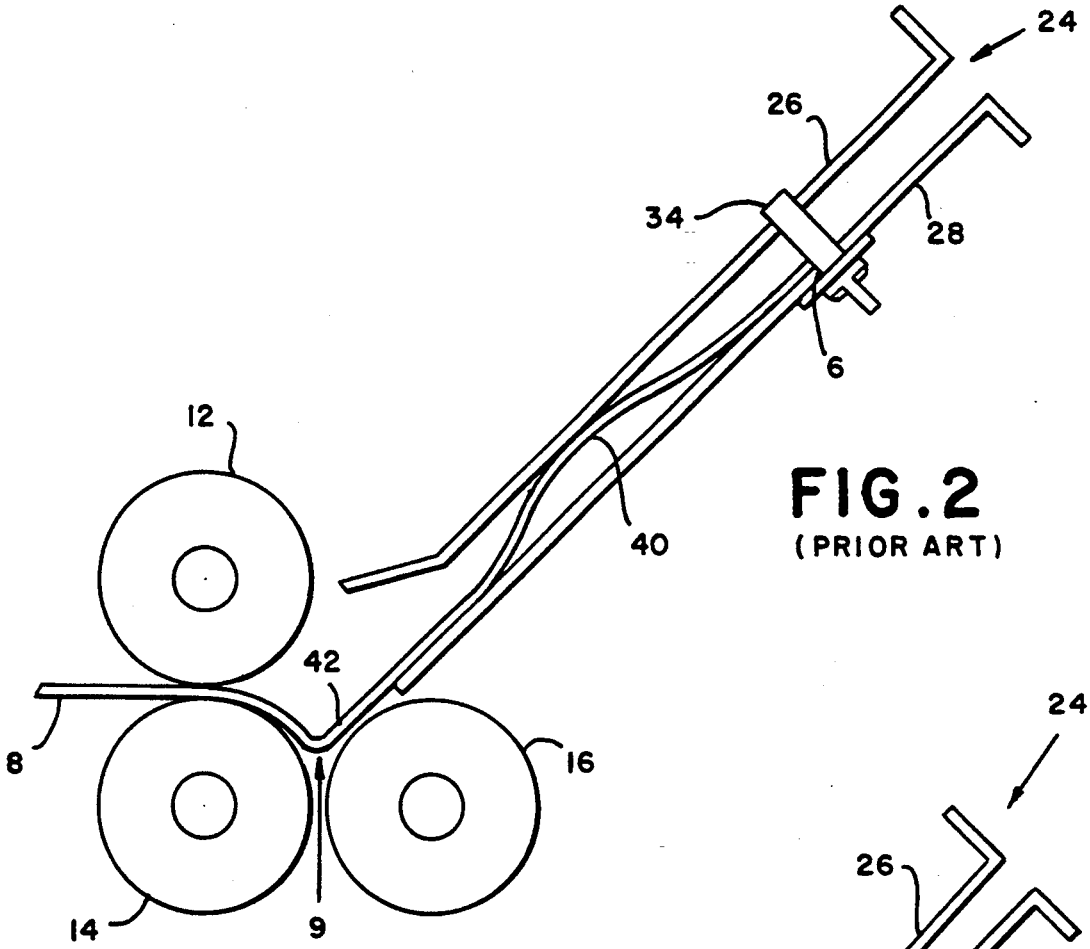
FIG. 2 (PRIOR ART)
FIG. 2 is a schematic side elevational view of the prior art folder of FIG. 1.

In describing the present invention, reference is made to the drawings, wherein there is seen in FIGS. 1 and 2 a prior art buckle chute folder, generally designated 10, consisting of rollers 12, 14 and 16, and a buckle chute, generally designated 24. Buckle chute folders typically comprise one to four buckle chutes depending on the type of fold that is desired. In describing the present invention only one buckle chute and corresponding rollers will be described. It will be apparent to those skilled in the art that the present invention can be used with each of the buckle chutes or selected ones of the buckle chutes to obtain more precise folds of the document.

Buckle chute 24 comprises a pair of closely spaced parallel plates 26 and 28 having between them an plurality of adjustable stop elements 34. Stop elements 34 provide an abutment that stops the movement of leading edge 6 of sheet 8 as it moves through chute 24. There are a plurality of slots 32 in plates 26 and 28 through which stop elements 34 project.

Stopping the motion of leading edge 6 when it abuts stops 34 and simultaneously continuing to feed sheet 8 by rollers 12 and 14 causes a portion of sheet 8 backward of leading edge 6 to buckle and bulge transversely out of the plane of the sheet in the direction shown in FIG. 2. 0 Buckle chute 24 and rollers 12 and 14 are disposed so that the direction of formed bulge 9 in sheet 8 is toward between rollers 14 and 16 which grasp bulge 9 in the nip therebetween, crease and fold bulge 9, and pull sheet 8 therethrough to form a fold in sheet 8.

It has been found that when leading edge 6 abuts stops 34 sheet 8 buckles at one or more additional locations in sheet 8 within chute 24 between plates 26 and 28. For example, as seen in FIG. 2, a second bulge 40 occurs within chute 24. The buckling of sheet 8 occurs at bulge 9 because the buckling within chute 24 is limited by the size of the gap between plates 26 and 28.

Typically, the gap between plates 26 and 28 is a standard gap that can handle up to the maximum number of sheets at one time. In many cases, the standard gap is suitable for causing an acceptable fold in the sheets processed through the buckle chute folder 10. But the standard gap setting does not facilitate a precision fold exactly on a perforated line in sheet 8. As seen in FIG. 2, perforated line 42 in sheet 8 will be above the line of fold 9.

Figure 4:
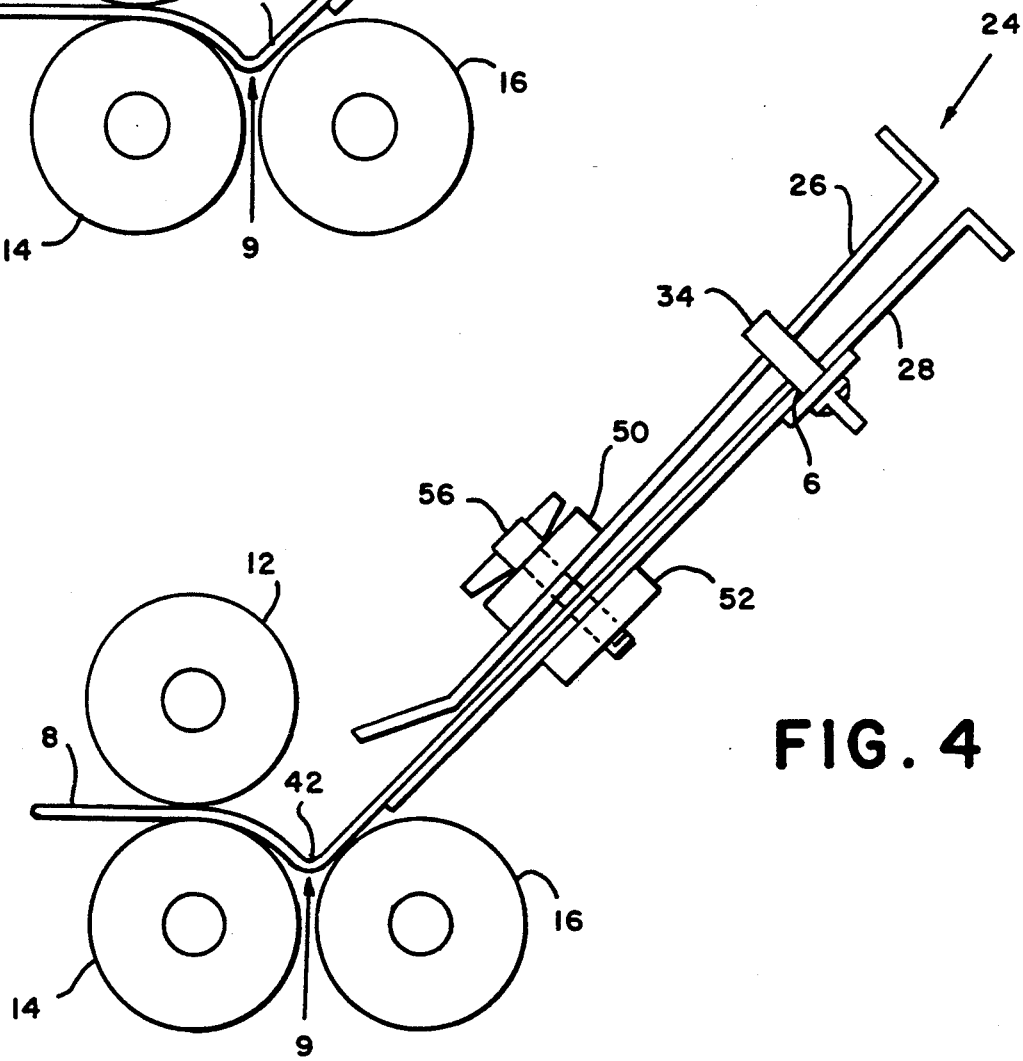
FIG. 4 is a schematic side view of the buckle chute and compression plates of FIG. 3 along line 4—4.
Figure 3:
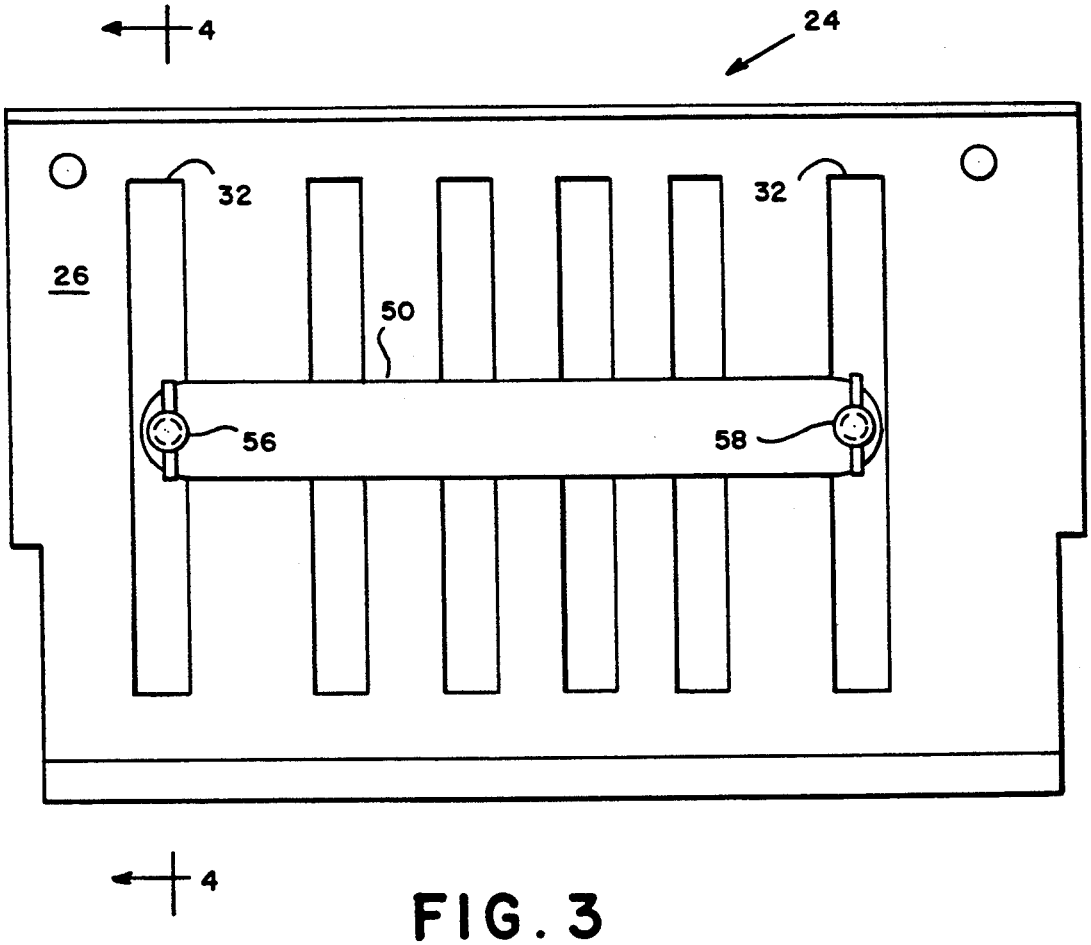
FIG. 3 is a front view of a buckle chute with compression plates in accordance with the present invention.
Figure 5:
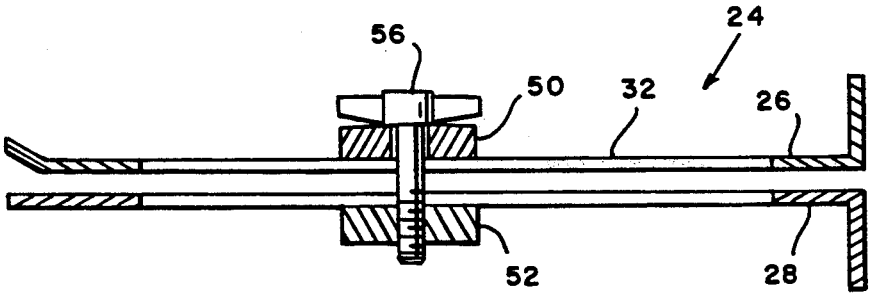
FIG. 5 is a schematic side elevational view of the folder of a buckle chute folder of FIG. 1 with the compression plates of FIG. 3 adjusted to minimized fluctuation of sheets as they are buckled into the fold rollers.

Referring now to FIGS. 3–5, an improvement to the buckle chute folder 10 is shown which provides an adjustment to the gap between plate 26 and 28 so that a more precise fold on the perforated line 42 can be achieved. Specifically, compression plates 50 and 52 are transversely mounted to the outside of plate 26 and 28 respectively. Compression plates 50 and 52 are held in place by thumb screws 56 and 58 which respectively fit through apertures in compression plate 50, extend through the outermost slots 32, and are screwed into threaded apertures in compression plate 52.

Thus, the gap in the lower end of buckle chute 24 can be narrowed to minimized the bulging of sheet 8 within chute 24 when leading edge 6 of sheet 8 abuts stop 34. By minimizing the bulging of sheet 8 within chute 24, the location of the fold line on sheet 8 can be controlled more precisely. As seen in FIG. 5, the compression plates 50 and 52 have been tightened to shorten the gap whereby perforated line 42 in sheet 8 is located at the bulge 9 entering the nip between rollers 14 and 16. Thus, the fold line on sheet 8 will be on perforated line 42.

Compression plates are adjustably located on buckle chute 24 by loosening screws 56 and 58 and sliding plates 50 and 52 up or down chute 24 to achieve the desired gap adjustment.

It will be understood by those skilled in the art that alternate means for adjusting the standard gap between the chute plates could be used as well. For example, adjustment screws can be mounted directly to plates 26 and 28 in a conventional manner whereby the desired gap is achieved by turning the adjustment screws.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. In a buckle chute folding apparatus having at least one buckle chute and including a first pair of rollers for feeding one or more sheets into the buckle chute, the buckle chute including upper and lower chute plates having a predetermined gap therebetween and a plurality of stops positioned in within the buckle chute such that the sheet buckles and forms a bulge in the sheet that is grasp by a pair of folding rollers which complete the fold, an improvement comprising:

a pair of compression plates, each of said compression plates being secured respectively on the outer face of the upper and lower chute plates, said pair of compression plates including means for narrowing the predetermined gap between the upper and lower chute plates whereby buckling of the sheet within the buckle chute is minimized, wherein said compression plates are adjustably positioned on the face of the chute plates whereby the gap between the chute plates can be narrowed at a selected location so that the desired fold can be achieved.

2. The method of controlling the location of a fold by a buckle chute folder, comprising the steps of:

a) providing a pair of feed rollers;

b) providing a buckle chute having upper and lower chute plates and a plurality of stops therein for causing a sheet fed therein by the feed rollers to buckle;

c) providing a pair of fold rollers for folding the sheet at the buckle location on the sheet;

d) providing a pair of compression plates mounted on the outer surfaces of the upper and lower chute plates;

e) adjusting the longitudinal position of the compression plates on the outer surface of the upper and lower chute plates; and f) adjusting the tightness of the compression plates to adjust a gap between the upper and lower chute plates.

* * * * *